US012398333B2

(12) United States Patent
Khan et al.

(10) Patent No.: US 12,398,333 B2
(45) Date of Patent: Aug. 26, 2025

(54) METHOD TO MAXIMIZE STABILIZED CRUDE RECOVERY FROM GAS CONDENSATE

(71) Applicant: SAUDI ARABIAN OIL COMPANY, Dhahran (SA)

(72) Inventors: Ashiff Khan, Thrissur (IN); Hatem Bajuaifer, Jeddah (SA); Ali T. Hajji, Al-Ahsa (SA); Ahmad M. Hawsawi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 301 days.

(21) Appl. No.: 18/180,618

(22) Filed: Mar. 8, 2023

(65) Prior Publication Data

US 2024/0301299 A1 Sep. 12, 2024

(51) Int. Cl.
*C10G 53/04* (2006.01)

(52) U.S. Cl.
CPC ..... *C10G 53/04* (2013.01); *C10G 2300/201* (2013.01); *C10G 2300/4012* (2013.01); *C10G 2300/4081* (2013.01)

(58) Field of Classification Search
CPC .. C10G 53/04; C10G 53/02; C10G 2300/201; C10G 2300/4012; C10G 2300/4081
See application file for complete search history.

(56) References Cited

U.S. PATENT DOCUMENTS 2,389,604 A 11/1945 Dowding
9,555,345 B2 1/2017 Al-Shafei et al.
10,099,200 B1 10/2018 Chandran et al.
10,767,121 B2 9/2020 Soliman
11,008,521 B1 5/2021 Raynel et al.
11,230,676 B1 1/2022 Koseoglu
(Continued)

FOREIGN PATENT DOCUMENTS

CN 111346396 A 6/2020
IN 1080/DEL/2010 A 11/2012

OTHER PUBLICATIONS

Rahmanian et al., "Process simulation and assessment of a back-up condensate stabilization unit," Journal of Natural Gas Science and Engineering, 26 (2015) 730e736, Jul. 6, 2015, 7 pages.

*Primary Examiner* — Prem C Singh
*Assistant Examiner* — Juan C Valencia
(74) *Attorney, Agent, or Firm* — Osha Bergman Watanabe & Burton LLP

(57) ABSTRACT

A gas oil separation plant including a high pressure production trap for receiving a feed stream and producing a first produced liquid and a first gas stream, a low pressure production trap for receiving the first produced liquid and producing a second produced liquid and a second gas stream, a low pressure compressor knockout drum for receiving the second gas stream and separating the second gas stream into a first overhead gas stream and a first liquid stream, a high pressure first stage knockout drum for receiving the first overhead gas stream and first gas stream and producing a second overhead gas stream and a second liquid stream, a product condensate outlet for receiving a portion of a condensate recycle stream, and a recycle system for recycling a remaining portion of the condensate recycle stream to the HPPT, LPPT, or both.

19 Claims, 1 Drawing Sheet

(56) References Cited

U.S. PATENT DOCUMENTS

| | | | | |
|---|---|---|---|---|
| 11,352,574 | B2 | 6/2022 | Soliman | |
| 2018/0066194 | A1* | 3/2018 | Soliman | C10G 31/06 |
| 2021/0309922 | A1 | 10/2021 | Soliman et al. | |
| 2022/0081622 | A1 | 3/2022 | Gajbhiye et al. | |

* cited by examiner

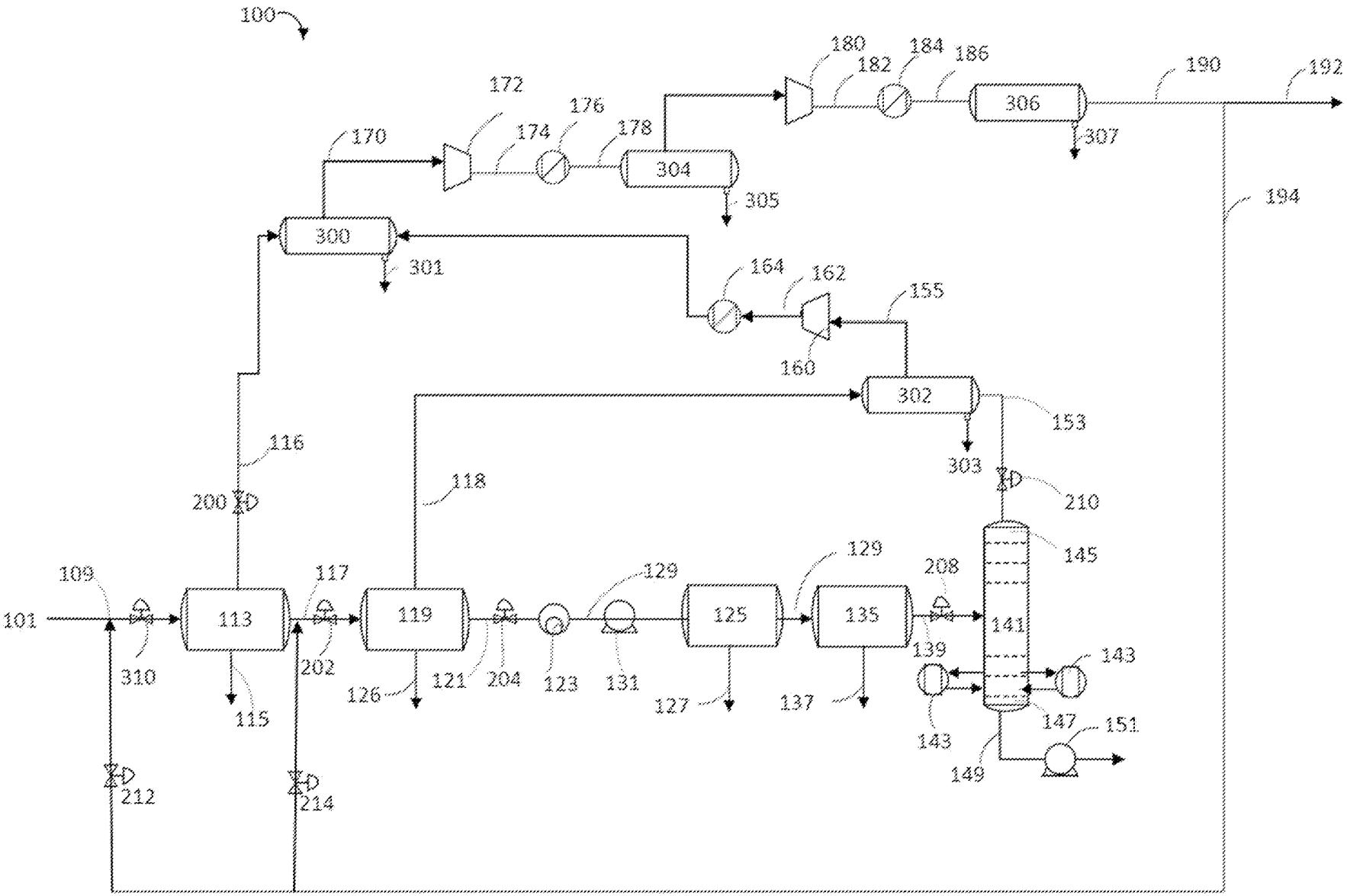
100
101
109
310
212
113
115
200
116
214
202
117
119
126
121
204
118
123
131
129
125
127
135
137
139
208
143
141
145
147
149
151
143
210
153
302
303
155
160
162
164
304
305
178
176
174
172
300
301
170
306
307
186
184
182
180
190
194
192

METHOD TO MAXIMIZE STABILIZED CRUDE RECOVERY FROM GAS CONDENSATE

BACKGROUND

A gas-oil separation plant (GOSP) is a plant used in the processing of crude oil that separates lighter components and other materials from a crude oil stream. There are multiple hydrocarbon streams of differing compositions in the gas-oil separation plant. Hydrocarbons in these streams are substantially free of hydrogen, and may comprise one or more of H2S, CO2, N2, methane, ethane, propane, butanes, pentanes, hexanes, and heavier hydrocarbons.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a gas oil separation plant. The gas oil separation plant includes a high pressure production trap (HPPT) configured for receiving a feed stream and producing a first produced liquid and a first gas stream, a low pressure production trap (LPPT) configured for receiving the first produced liquid and producing a second produced liquid and a second gas stream, a low pressure compressor knockout drum configured for receiving the second gas stream and separating the second gas stream into a first overhead gas stream and a first liquid stream, a high pressure first stage knockout drum configured for receiving the first overhead gas stream and first gas stream and producing a second overhead gas stream and a second liquid stream, a compression system configured for receiving the second overhead gas stream and producing a condensate recycle stream, a product condensate outlet for receiving a portion of the condensate recycle stream as a product condensate stream, and a recycle system configured for recycling a remaining portion of the condensate recycle stream to the HPPT, LPPT, or both.

In another aspect, embodiment disclosed herein relate to a process for the production of stabilized crude oil and gas oil condensate. The process includes separating a crude oil feedstock in a high pressure production trap (HPPT), producing a first produced liquid and a first gas stream; separating a low pressure production trap (LPPT) configured for receiving the first produced liquid and producing a second produced liquid and a second gas stream; separating the second gas stream in a low pressure compressor knockout drum, producing a first overhead gas stream and a first liquid stream; separating the first overhead gas stream and first gas stream in a high pressure first stage knockout drum, producing a second overhead gas stream and a second liquid stream; compressing and cooling the second overhead gas stream in a compression system, producing a condensate stream; recovering at a least a portion of the condensate stream as a natural gas liquid product; and recycling a remaining portion of the condensate stream to the HPPT, the LPPT, or both, as a condensate recycle stream using a recycle system to maximize crude oil production Other aspects and advantages of the claimed subject matter will be apparent from the following description and the appended claims.

BRIEF DESCRIPTION OF DRAWINGS

FIG. 1 is a simplified flow diagram of a process for operating a gas-oil separation plant according to embodiments herein.

DETAILED DESCRIPTION

In one aspect, embodiments disclosed herein relate to gas-oil separation plants. More specifically, embodiments herein relate to gas-oil separation plants for compressing and separating hydrocarbons, where produced liquids from gas compressors knock out drums in a gas-oil separation plant are recycled to the feed hydrocarbons.

The use of internally generated hydrocarbon streams from gas compression reduces the need for separate feedstocks in gas plants or can be used for maximizing value added products. In one or more embodiments, this may enable the gas-oil separation plant to meet the gas and NGL export specifications with less process equipment than would be necessary if recycle were not used. Embodiments herein may also result in improved condensate specification and stabilization, having a lesser content of light ends, such as C3 and lighter hydrocarbons and water, as well as improved gas specifications, having lesser content of heavy ends, such as C4 and heavier hydrocarbons. In some embodiments, the separated water may include some oily components. Accordingly, "water" and "liquid" are used interchangeably throughout this description.

Crude oil produced from various formations is a wide boiling mixture and includes light hydrocarbons (ethane, propanes, butanes) and heavier hydrocarbons (pentanes, hexanes, heptanes, octanes, nonanes, etc., up to gas oils, asphaltenes, etc). This crude oil is often initially processed in a crude processing plant to remove the light ends and produce a stabilized or unstabilized export crude having little to no light hydrocarbons. For example, a crude processing plant may include a high-pressure separator, such as a high-pressure production trap operating at about 50 to 150 psig, which may perform an initial separation of the crude, resulting in a high-pressure gas stream and a high-pressure liquid stream. The pressure of the liquid may then be let down, such as to 50 psig (30 psig to 165 psig), and separated to form a low-pressure gas stream and a low-pressure liquid stream. A further pressure reduction, such as to less than 5 psig (0 psig to 65 psig) and separation in a crude stabilizer, such as at low pressure, may result in a low pressure gas stream and a stabilized crude oil product. The temperature of such feed and product streams may vary, and in some embodiments may range from ambient temperature to 150° F. for example.

Gas-oil separation plants according to embodiments herein include a gas plant, gas compression plant, dehydration, refrigeration, chilling, a flow system, and a gas dew-point control plant. The gas compression plant may receive a high-pressure gas stream, and a low-pressure gas stream, compressing each in the gas compression plant which produces a condensate stream and a compressed gas stream. The condensate product stream may be divided by the flow system into an export condensate stream, recovered as both a product stream and a stream recycled to upstream separators.

In one or more embodiments, one or more of the hydrocarbon gas streams received from the crude processing plant is sour. That is, one or more of the hydrocarbon streams may comprise more than 10 ppm H2S. In other embodiments, the hydrocarbon stream may comprise from 10 ppm H2S to 50,000 ppm H2S.

One or more of the hydrocarbon streams received from the crude processing plant may also be "wet", meaning that the feed stream as provided to the gas-oil separation plant includes a mixture of liquid and vapor where water vapor is present in an amount above 7 lb/MMSCF of gas.

The gas compression plant according to embodiments herein includes a first compression train configured to receive a high-pressure stream from a crude processing plant, a second compression train configured to receive a low-pressure gas stream from the crude processing plant, and feed to the first compression train, and a third compression train configured to receive a high-pressure gas stream from the discharge of the first compression train in the crude processing plant or from the crude processing plant. Each of the first, second, and third compression trains may include a suction knockout drum, a compressor, an aftercooler, and a discharge knockout drum. A knockout drum (KOD) is a simple vessel for separating vapor and liquid in a stream having both vapor and liquid. A suction knockout drum (suction KOD) may be used to prevent liquid from entering a compressor, for example. A discharge knock-out drum may be used to separate condensate, liquid resulting from compression in the compressor and cooling in the aftercooler, from compressed gases resulting from the compression. Each compression train thus outputs a compressed gas stream and a liquid condensate stream.

Embodiments disclosed herein relate to a gas oil separation plant. The gas oil separation plant includes a gas compression plant, configured to receive, compress, and separate one or more feed streams into a compressed gas stream and a condensate stream, a flow system for dividing the condensate stream into an export condensate stream and a recycled stream to upstream separation traps.

Embodiments herein include modifying the route of gas condensate to the condensate stripper in gas plants back to upstream separation traps in GOSP. This modified process stream with modified process controls has been found to enhance crude yield by minimum 300-500 bbls/day in a 300 thousand barrels per calendar day (MBCD) GOSP. The gas condensate from various sources as shown in schematic can be diverted to high pressure production trap (HPPT), or low pressure production trap (LPPT), or a combination of both, depending on the composition of gas condensate and design limitations of downstream unit operations. Accordingly, the flow to HPPT and LPPT can be maximized to increase stabilized crude production.

Alternatively, using the modified control scheme, gas condensate can be partially diverted to maximize stabilized crude recovery while maintaining minimum C3+ condensate byproduct as needed. The flow can be diverted using a suitable controller that operates based on split range, or selector or ratio to upstream traps or connected gas plants or a combination of both as needed.

For example, the first compression train, processing the HP gas stream, may compress the HP gas in the HP compressor to about 50 to 60 psig. Discharge gas from the HP compressor is cooled in the after cooler to 90-120° F. to condense a portion of the heavy hydrocarbons such as C3H8, C4H10, C5H12, C6+ from the compressed gas. Hydrocarbon condensate is then separated in the HP compressor discharge knockout drum.

A flow line may be provided for feeding the compressed gas from the LP compressor discharge knockout drum to the suction knockout drum of the first compression train, thus processing the compressed gas product along with the low-pressure gas feed stream from the crude processing plant in the second compression train. In the second compression train, the LP compressor compresses the combined gases to 50-60 psig. The discharge gas from LP compressor is then cooled in the after cooler to 90-120° F. to condense heavy hydrocarbons such as C3H8, C4H10, C5H12, C6+ from the gas. Hydrocarbon condensate is then separated in the LP compressor discharge Knockout Drum (KOD).

A flow line may be provided for feeding the compressed gas from the LP compressor discharge knockout drum to the suction knockout drum of the first compression train, thus processing the compressed LP gas product along with the high-pressure gas feed stream from the crude processing plant in the first compression train. In the first compression train, the HP compressor compresses the gas to 200 to 300 psig. The discharge gas from the HP compressor is cooled in the after cooler to 90-120° F. to condense heavy hydrocarbons such as C3H8, C4H10, C5H12, C6+ from the gas. Hydrocarbon condensate is then separated in the HP compressor discharge Knockout Drum (KOD).

In one or more embodiments, the condensate may comprise hydrocarbons containing 3 carbon atoms or more. The C3+ content in the condensate stream may have a range with an upper limit of any of 90% or 80%, and a lower limit of 0%, 10%, 20%, 30%, 40%, or 50% in one or more embodiments. In some embodiments, the operating pressure of the condensate stream, following pressure reduction upstream of the gas chiller, is within the range from 0 psia to 150 psig. In one or more embodiments, the temperature of the condensate stream, following pressure reduction upstream of the gas chiller, is in the range from 50° F. to 70° F. The percentage of condensate that may be recycled may vary based on the cooling requirements; a greater percentage of condensate may be recycled with greater cooling requirements, with anywhere from 0 to 100% able to be recycled.

One or more of the hydrocarbon streams may be dehydrated using a dehydration system. This system removes water or liquid and, in one or more embodiments, may remove other contaminants. The dehydration system may include a TEG Contactor, which utilizes triethylene glycol to absorb water from the hydrocarbon stream. Water is removed to avoid hydrate formation and corrosion in the export gas pipeline systems or downstream equipment. In one or more embodiments, heat is utilized to remove water from the triethylene glycol in order to recycle the triethylene glycol.

In one or more embodiments, an advanced process control (APC) system using model predictive controllers in combination with machine learning and artificial intelligence may be used to monitor and control the overall cooling requirements in the dewpoint control plant and/or the gas compression plant while manipulating the condensate flowrates. In some embodiments, the prediction models for the process variables may be created using mechanistic model or by experiment during or by using the artificial intelligence of the historical data. Also, the APC may be utilized to avoid violating the hard constraints like hydrate formation of the gas or the power limits of the compressor motors. In one or more embodiments, controlled variables may include the gas chiller outlet gas temperature, the gas chiller outlet condensate temperature, and the outlet temperatures of the refrigerant from the other cooling demands.

In some embodiments, the control system may be configured to receive temperature measurements from temperature sensors disposed on flowlines associated with each of the cooled and compressed streams respectively downstream of each aftercooler. Temperature measurements may also be received from flow lines on the export gas product stream downstream of the gas chiller. When additional cooling is present, temperature measurements may further be provided from flow streams measuring a temperature of the warmed condensate refrigerant downstream of the various heat exchangers receiving condensate refrigerant. Using these temperature measurements, the control system may be configured to control a temperature of the chilled compressed gas stream (the compressed, dehydrated, and dew-point-controlled product stream), as well as the temperature of any chilled process streams downstream of any additional cooling heat exchangers. To achieve the desired temperature control, the control system may be configured to control a flow rate of the refrigerant stream fed to the gas chiller, control a flow rate of the condensate refrigerant fed to heat exchangers for the additional cooling requirements, as well as the excess condensate fed to the condensate collection drum from the condensate collection and distribution system and/or the flow rate of condensate product.

Specific embodiments utilizing one or more of the above-described flow schemes related to the condensate collection and condensate recycle are illustrated in FIG. 1, described below.

Embodiments disclosed herein relate to a gas oil separation plant. The gas oil separation plant includes a gas compression plant, configured to receive, compress, and separate one or more feed streams into a compressed gas stream and a condensate stream, a flow system for dividing the condensate stream into an export condensate stream and a recycled stream to upstream separation HPPT and LPPT.

Embodiments herein include modifying the route of gas condensate to the condensate stripper in gas plants back to upstream separation traps in GOSP. This modified process stream with modified process controls has been found to enhance crude recovery by minimum 300-500 bbls/day in a 300 MBCD GOSP. The gas condensate from various sources as shown in schematic can be diverted to high pressure production trap (HPPT), or low pressure production trap (LPPT), or a combination of both, depending on the composition of gas condensate and design limitations of downstream unit operations. Accordingly, the flow to HPPT and LPPT can be maximized to increase stabilized crude production.

Alternatively, using the modified control scheme, gas condensate can be partially diverted to maximize stabilized crude recovery while maintaining minimum C3+ condensate byproduct as needed. The flow can be diverted using a suitable controller that operates based on split range, or selector or ratio to upstream traps or connected gas plants or a combination of both as needed.

FIG. 1 illustrates a schematic diagram showing a GOSP used to capture gas according to one or more example embodiments. The system comprises processing equipment and unit operations that will be described in detail; exemplary operating conditions are provided, but other appropriate conditions may be used for the various unit operations. The GOSP 100 receives a crude feed (produced fluid) 101 containing crude oil and natural gas from production wells in a hydrocarbon-bearing formation. The produced fluid 101 may include crude oil, saline water, natural gas, and other constituents.

The produced fluid 101 flows into a flow pipe 109 that is fluidly coupled to a control valve 310. The produced fluid in the flow pipe 109 may be high pressure fluids. According to one or more embodiments, high pressure fluids and gases are in a pressure range from about 140 pounds per square inch gauge (psig) to about 450 psig, low pressure fluids and gases are in a pressure range from about 40 psig to about 100 psig, and other low pressure fluids and gases are in a range from about 14 psig to about 25 psig. The flow pipe 109 directs the high pressure produced fluid 101 into a fluidly coupled high pressure production trap (HPPT) 113. The HPPT may be configured to separate high pressure gases from the produced fluid, producing a partially degassed crude oil.

The HPPT may also be configured to separate water or liquid from the produced fluid. The separated water or liquid may be removed from the HPPT 113 through flow pipe 115 fluidly coupled to the HPPT 113. The decrease in pressure in the HPPT 113 causes lighter hydrocarbon gases in the crude oil to separate from the heavier liquid hydrocarbons. Lighter hydrocarbon gases may include C1-C4 hydrocarbons such as, methane, ethane, propane, butane, and iso-butane. Heavier liquid hydrocarbons may include C5 and greater hydrocarbons such pentane, iso-pentane, and hexane. According to one or more embodiments, the operating conditions in HPPT 113 include temperature in a range from about 65° F. to about 130° F. and operating pressure at about 150 psig. The HPPT 113 has an outlet fluidly coupled by a flow pipe 116 to a high pressure first stage knock out drum (KOD) 300 though a first valve 200. The first stage KOD 300 is configured to operate at a pressure lower than the HPPT 113, such as a pressure in the range of 20 to 70 psig.

The partially degassed crude oil flows from the HPPT 113 and passes into a flow pipe 117 that is fluidly coupled to a control valve 202. The flow pipe 117 directs the partially degassed crude oil from the HPPT 113 and into a fluidly coupled low pressure production trap (LPPT) 119. The partially degassed crude oil entering the LPPT 119 from the HPPT 113 may still contain some gas and water. The LPPT 119 may be configured to remove more of the remaining gas and water from the produced fluid. The LPPT 119 operates at a lower pressure than HPPT 113 and separates gases at a low pressure from the partially degassed crude oil. According to one or more embodiments, operating conditions in the LPPT include temperature ranging from about 65° F. to about 130° F. and pressure of about 50 psig. The LPPT 119 may have an outlet fluidly coupled to another flow pipe 126 configured to remove water or liquid from the partially degassed crude oil. The LPPT 119 has an outlet fluidly coupled by a flowline 118 to the low pressure compressor KOD 302. The low pressure KOD 302 is configured to operate a pressure lower than the LPPT 119, such as a pressure in the range of 1 to 5 psig.

The degassed crude oil flows from the LPPT 119 and into a flow pipe 121 that is fluidly coupled to a control valve 204, and into a heat exchanger 123. The heat exchanger 123 is configured to transfer heat between the produced fluid and another fluid. Heating of the degassed crude oil, and any remaining water or liquid and gas from the LPPT allows for easier separation of water from crude oil in the degassed crude oil. Further, the heating of crude oil in the degassed crude oil improves separation of oil from water by allowing the coalescence of water droplets and settling out of water in the liquid phase, and the heating also encourages removal of gases from the crude oil.

The degassed crude oil containing a heated crude oil stream among other constituents flows from the heat exchanger 123 and into a flow pipe and passes into a fluidly coupled dehydrator 125 with pressure between about 125 to about 175 psig. Dehydrator 125 is a separator configured to remove water or liquid from the heated crude oil stream. The dehydrator 125 may have an outlet fluidly coupled to another flow pipe 127 configured to remove water or liquid from the degassed crude oil. According to one or more embodiments, the operating conditions in the dehydrator 125 include temperature in a range from about 80° F. to about 160° F. and pressure from about 125 psig to 175 psig. The heat exchanger 123 and pump 131 may be sufficient to achieve the inlet conditions required by the dehydrator 125.

The dehydrated crude oil stream is passed from the dehydrator 125 to a flow pipe 129. The dehydrated crude oil stream is then passed into a fluidly coupled desalter unit 135. The dehydrated crude oil may include water and brine that occur naturally or injected during secondary oil recovery operations. The desalter unit 135 is configured to remove water and salt from the dehydrated crude oil stream to increase the separation of water from the oil. The desalter unit 135 has an outlet fluidly coupled to another flow pipe 137 configured to receive removed water or liquid from the desalter unit 135. According to one or more embodiments, the operating conditions in desalter unit 135 may include temperature in a range from about 150° F. to about 180° F.

The dehydrated and desalted crude oil passes from desalter unit 135 and into a fluidly coupled flow pipe 139. The flow pipe 139 is fluidly coupled to a control valve 208 that passes the desalted crude oil into a fluidly coupled stabilizer 141. The stabilizer 141 may contain multiple stabilizer trays where crude oil flows down each tray until the crude oil reaches a draw-off stabilizer tray. The stabilizer 141 may be fluidly coupled to one or more reboilers 143. The one or more reboilers 143 may be configured to heat dry crude oil from a tray and return it to stabilizer 141.

The stabilizer 141 is configured for sweetening and stabilization of the crude oil. In the sweetening process, dissolved hydrogen sulfide ($H_2S$) gas from crude oil is removed. In the stabilization process, heat is used to remove light components that may include any remaining dissolved gases, volatile hydrocarbons, and H2S. Sweeting and stabilization cause the crude oil in the stabilizer 141 to separate into two components: atmospheric gas that may collect at a top section 145 of the stabilizer 141 and sweetened and stabilized crude oil that may collect at a bottom section 147.

The stabilized crude oil in the stabilizer 141 may pass from that stabilizer 141 into a fluidly coupled flow pipe 149. The flow pipe 149 is fluidly coupled to a pump 151 that sends the stabilized crude for shipping and sale. The light components in the crude oil that have vaporized and risen through the top section 145 of stabilizer 141 are passed to a fluidly coupled flow pipe 153 to the low pressure compressor KOD 302 through a control valve 210.

The low pressure compressor KOD 302 may be configured to separate the gas in the vaporized hydrocarbon in flow pipe 153 into a water or liquid stream 303 and a first overhead hydrocarbon stream 155. The first overhead hydrocarbon stream 155 is fed to a low pressure compressor 160 which may be configured to increase the pressure of the hydrocarbon stream 155 from a suction pressure of 1 to 5 psig to a discharge pressure in the range of 30 to 70 psig, producing a pressurized first overhead hydrocarbon stream 162. The pressurized first overhead hydrocarbon stream 162 may then be fed to a low pressure aftercooler 164 configured to reduce the temperature of the pressurized first overhead hydrocarbon stream 162 to a temperature in the range of 100 to 130° F. The cooled, pressurized first overhead hydrocarbon stream may then be fed to the high pressure first stage KOD 300.

The high pressure first stage KOD 300 may be configured to reduce the pressure of hydrocarbons in the cooled, pressurized first overhead hydrocarbon stream and hydrocarbons in flow line 116, producing a water or liquid stream 301 and a second overhead hydrocarbon stream 170. The pressure in the second overhead hydrocarbon stream 170 may be in the range of 30 to 70 psig.

The second overhead hydrocarbon stream 170 is fed to a first high pressure compressor 172 which may be configured to increase the pressure of the second overhead hydrocarbon stream 170 from a suction pressure in the range of 30 to 70 psig to a discharge pressure in the range of 200 to 300 psig, such as about 250 psig, producing a pressurized second overhead hydrocarbon stream 174. The pressurized second overhead hydrocarbon stream 174 may then be fed to a high pressure aftercooler 176 configured to reduce the temperature of the pressurized second overhead hydrocarbon stream 174 to a temperature in the range of 100 to 150° F. The cooled, pressurized second overhead hydrocarbon stream may then be fed to a high pressure second stage KOD 304.

The high pressure second stage KOD 304 may be configured to reduce the pressure of hydrocarbons in the cooled, pressurized second overhead hydrocarbon stream 178, producing a water or liquid stream 305 and a third overhead hydrocarbon stream. The pressure in the third overhead hydrocarbon stream may be in the range of 200 to 300 psig.

The third overhead hydrocarbon stream is fed to a second high pressure compressor 180 which may be configured to increase the pressure of the third overhead hydrocarbon stream from a suction pressure in the range of 200 to 300 psig to a discharge pressure pressure in the range of 400 to 600 psig, such as about 500 psig, producing a pressurized third overhead hydrocarbon stream 182. The pressurized third overhead hydrocarbon stream 182 may then be fed to a second high pressure aftercooler 184 configured to reduce the temperature of the pressurized third overhead hydrocarbon stream 182 to a temperature in the range of 120 to 160° F. The cooled, pressurized third overhead hydrocarbon stream 186 may then be fed to a discharge KOD 306.

The discharge KOD may be configured to reduce the pressure of hydrocarbons in the cooled, pressurized third overhead hydrocarbon stream 186, producing a water or liquid stream 307 and a discharge condensate hydrocarbon stream 190. The pressure of the discharge condensate hydrocarbon stream 190 may be in the range of 250 to 350 psig.

In one or more embodiments, a portion of the discharge condensate hydrocarbon stream 190 is taken as product NGL condensate 192 and fed to one or more downstream gas trains (not illustrated). The remaining portion of the discharge condensate hydrocarbon stream 190 is taken as recycle condensate 194. The recycle condensate 194 may be directed toward control valves 212 and 214 to HPPT 113 and LPPT 119, respectively. This recycled condensate can be partially diverted to HPPT 113 and LPPT 119 to maximize stabilized crude recovery while maintaining minimum C3+ condensate byproduct as needed.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A gas oil separation plant, comprising:

a high pressure production trap (HPPT) configured for receiving a feed stream and producing a first produced liquid and a first gas stream;

a low pressure production trap (LPPT) configured for receiving the first produced liquid and producing a second produced liquid and a second gas stream;

a low pressure compressor knockout drum configured for receiving the second gas stream and separating the second gas stream into a first overhead gas stream and a first liquid stream;

a high pressure first stage knockout drum configured for receiving the first overhead gas stream and first gas stream and producing a second overhead gas stream and a second liquid stream;

a compression system configured for receiving the second overhead gas stream and producing a condensate recycle stream;

a product condensate outlet for receiving a portion of the condensate recycle stream as a product condensate stream; and a recycle system configured for recycling a remaining portion of the condensate recycle stream to the HPPT, LPPT, or both.

2. The gas oil separation plant of claim 1, wherein the compression system further comprises:

a first stage high pressure compressor configured for receiving the second overhead gas stream and producing a compressed second overhead gas stream; and a first stage intercooler configured for receiving the compressed second overhead gas stream and producing a cooled second overhead gas stream.

3. The gas oil separation plant of claim 2, wherein the compression system further comprises:

a high pressure second stage knockout drum configured for receiving the cooled second overhead gas stream and producing a third overhead gas stream and a third liquid stream;

a second stage high pressure compressor configured for receiving the third overhead gas stream and producing a compressed third overhead gas stream; and a second stage intercooler configured for receiving the compressed third overhead gas stream and producing a cooled third overhead gas stream.

4. The gas oil separation plant of claim 3, further comprising a discharge knockout drum configured for receiving the cooled third overhead gas stream and producing the condensate recycle stream and a fourth liquid stream.

5. The gas oil separation plant of claim 1, further comprising:

a low pressure compressor configured for receiving the first overhead gas stream and producing a pressurized first overhead gas stream; and a low pressure intercooler configured for receiving the pressurized first overhead gas stream and producing a cooled first overhead gas stream; and a flow line configured for transporting the cooled first overhead gas stream to the high pressure first stage knockout drum.

6. The gas oil separation plant of claim 1, further comprising a dehydrator configured for receiving the second produced liquid, removing any entrained liquid, and producing a dehydrated produced liquid stream and a fifth liquid stream.

7. The gas oil separation plant of claim 6, further comprising a desalter configured for receiving the dehydrated produced liquid stream and producing a desalted crude product.

8. The gas oil separation plant of claim 7, further comprising a stabilizer column configured for receiving the desalted crude product and producing a stabilized crude export product stream and a stabilizer overhead gas stream.

9. The gas oil separation plant of claim 8 further comprising a flow line configured for feeding the stabilizer overhead gas stream to the low pressure compressor knockout drum.

10. A process for the production of stabilized crude oil and gas oil condensate comprising:

separating a crude oil feedstock in a high pressure production trap (HPPT), producing a first produced liquid and a first gas stream;

separating the first produced liquid in a low pressure production trap (LPPT), producing a second produced liquid and a second gas stream;

separating the second gas stream in a low pressure compressor knockout drum, producing a first overhead gas stream and a first liquid stream;

separating the first overhead gas stream and first gas stream in a high pressure first stage knockout drum, producing a second overhead gas stream and a second liquid stream;

compressing and cooling the second overhead gas stream in a compression system, producing a condensate stream;

recovering at a least a portion of the condensate stream as a natural gas liquid product; and recycling a remaining portion of the condensate stream to the HPPT, the LPPT, or both, as a condensate recycle stream using a recycle system to maximize crude oil production.

11. The process of claim 10, further comprising:

compressing the second overhead gas stream in a first stage high pressure compressor, producing a compressed second overhead gas stream; and cooling the compressed second overhead gas stream in a first stage intercooler, producing a cooled second overhead gas stream.

12. The process of claim 11, further comprising:

separating the cooled second overhead gas stream in a high pressure second stage knockout drum, producing a third overhead gas stream and a third liquid stream;

compressing the third overhead gas stream in a second stage high pressure compressor, producing a compressed third overhead gas stream; and cooling the compressed third overhead gas stream in a second stage intercooler, producing a cooled third overhead gas stream.

13. The process of claim 12, further comprising separating the cooled third overhead gas stream in a discharge knockout drum, producing the condensate recycle stream and a fourth liquid stream.

14. The process of claim 10, further comprising:

compressing the first overhead gas stream in a low pressure compressor, producing a pressurized fs; and cooling the pressurized first overhead gas stream in a low pressure intercooler, producing a cooled first overhead gas stream;

transporting the cooled first overhead gas stream, using a flow line, to the high pressure first stage knockout drum; and separating the cooled first overhead gas stream with the second overhead gas stream in the high pressure first stage knockout drum.

15. The process of claim 10, further comprising separating the second produced liquid in a dehydrator, removing any entrained water, and producing a dehydrated produced liquid stream and a fifth liquid stream.

16. The process of claim 15, further comprising separating the dehydrated produced liquid stream in a desalter, producing a desalted crude product.

17. The process of claim 16, further comprising feeding the desalted crude product to a stabilizer column, separating a stabilizer overhead gas stream from the desalted crude product, and producing a stabilized crude export product stream and a stabilizer overhead gas stream.

18. The process of claim 17, further comprising feeding the stabilizer overhead gas stream to the low pressure compressor knockout drum.

19. The process of claim 10, further comprising controlling the recycle system to minimize or eliminate the portion of the condensate stream recovered as the natural gas liquid product.

* * * * *